US006758792B1

(12) United States Patent
Chang

(10) Patent No.: US 6,758,792 B1
(45) Date of Patent: Jul. 6, 2004

(54) WAIST TRAINING MACHINE

(76) Inventor: Kuo-Yi Chang, No. 63, Lane 305, Sec. 3, Jungshan Rd. Tantz Shiang, Taichung County (TW), 427

( * ) Notice: Subject to any disclaimer, the term of this patent is extended or adjusted under 35 U.S.C. 154(b) by 0 days.

(21) Appl. No.: 10/453,637

(22) Filed: Jun. 4, 2003

(51) Int. Cl.[7] ..... A63B 22/02

(52) U.S. Cl. ..... 482/54; 482/55; 482/147; 482/118; 601/127; 601/126; 601/131; 128/58

(58) Field of Search ..... 482/54–55, 147–148, 482/118, 43, 62; 601/127–132; 128/58, 63, 56–57, 24.2, 24 R

(56) References Cited

U.S. PATENT DOCUMENTS 3,861,382 A * 1/1975 Simjian ..... 128/58
3,899,115 A * 8/1975 Simjian ..... 128/58
6,443,876 B1 * 9/2002 Huang ..... 482/54

* cited by examiner

*Primary Examiner*—Nicholas D. Lucchesi
*Assistant Examiner*—L Amerson
(74) *Attorney, Agent, or Firm*—Troxell Law Office PLLC

(57) ABSTRACT

A waist-twisting machine includes a post, a fixing base, a moving mechanism, a hoop body and a hull. The fixing base is movably combined with the post to move up and down, and the moving mechanism is deposited in the fixing base, consisting of a power source to rotate a gear unit, which then rotates two rotating arms connected with an interacting arm to make a horizontal movement in a circle as a hula hoop does. The hoop body is connected with the interactive arm to be moved in the same track as the interactive arm, with numerous massage rollers fixed on an inner surface of the hoop body. Then a user standing in the hoop body can be compelled to move together with the hoop body, with the waist thus twisted and massaged at the same time.

5 Claims, 7 Drawing Sheets

WAIST TRAINING MACHINE

BACKGROUND OF THE INVENTION

1. Field of the Invention

The invention relates to a waist-training machine, particularly to one automatically compelling a user to twist his/her waist in the same way as a hula-hoop, at the same time twisting the buttocks and massaging the waist with low pressure and raising the arms.

2. Description of the Prior Art

Many kinds of fitting equipment are widely used nowadays, for twisting the waist and buttocks, expanding the breast, lifting weights, jogging, bicycling etc. Traditional hula-hoops have been used for twisting the waist and the buttocks for acquiring body training owing to its soft smooth movement, very prevalent among consumers.

However, the traditional hula-hoops have some disadvantages.

1. A person should have certain experience or technique, or the person will be unable to maneuver it smoothly on the waist.
2. The traditional hula-hoop has a fixed size impossible to be adjusted, hardly adjustable for everybody.
3. In starting to move around the traditional hula-hoop on the waist, a person is prone to harm the waist, especially for the old.
4. A person has to concentrate on moving the traditional hula-hoop, impossible to do other work at the same time.
5. The traditional hula-hoop can only touch the waist at a point during moving around the waist, its effect in massaging may not so good as expected.

SUMMARY OF THE INVENTION

A main purpose of the invention is to offer a waist training machine provided with a number of massage rollers installed in an inner surface of a hoop body to carry out massage to the waist during receiving waist twisting movement to automatically make waist twisting and massaging synchronously.

A second purpose of the invention is to offer a waist training machine capable to be adjusted its speed of waist twisting in conjunction with clockwise and counterclockwise rotation adjustable according to the condition of a user's body, by handling a computer set on a panel with convenience.

BRIEF DESCRIPTION OF THE PREFERRED EMBODIMENT

Figure 1:
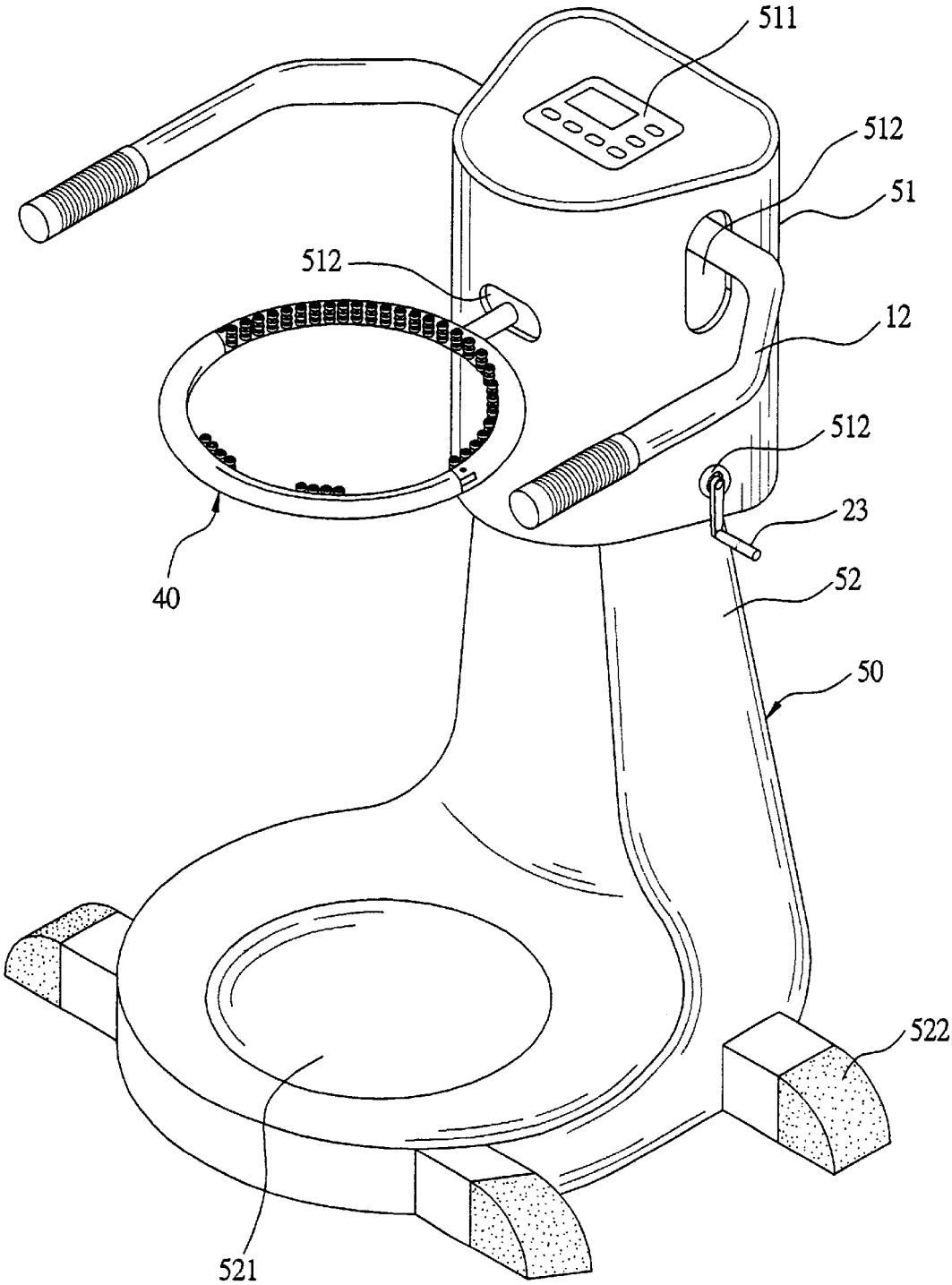
FIG. 1 is a perspective view of the waist training machine according to the present invention.
Figure 2:
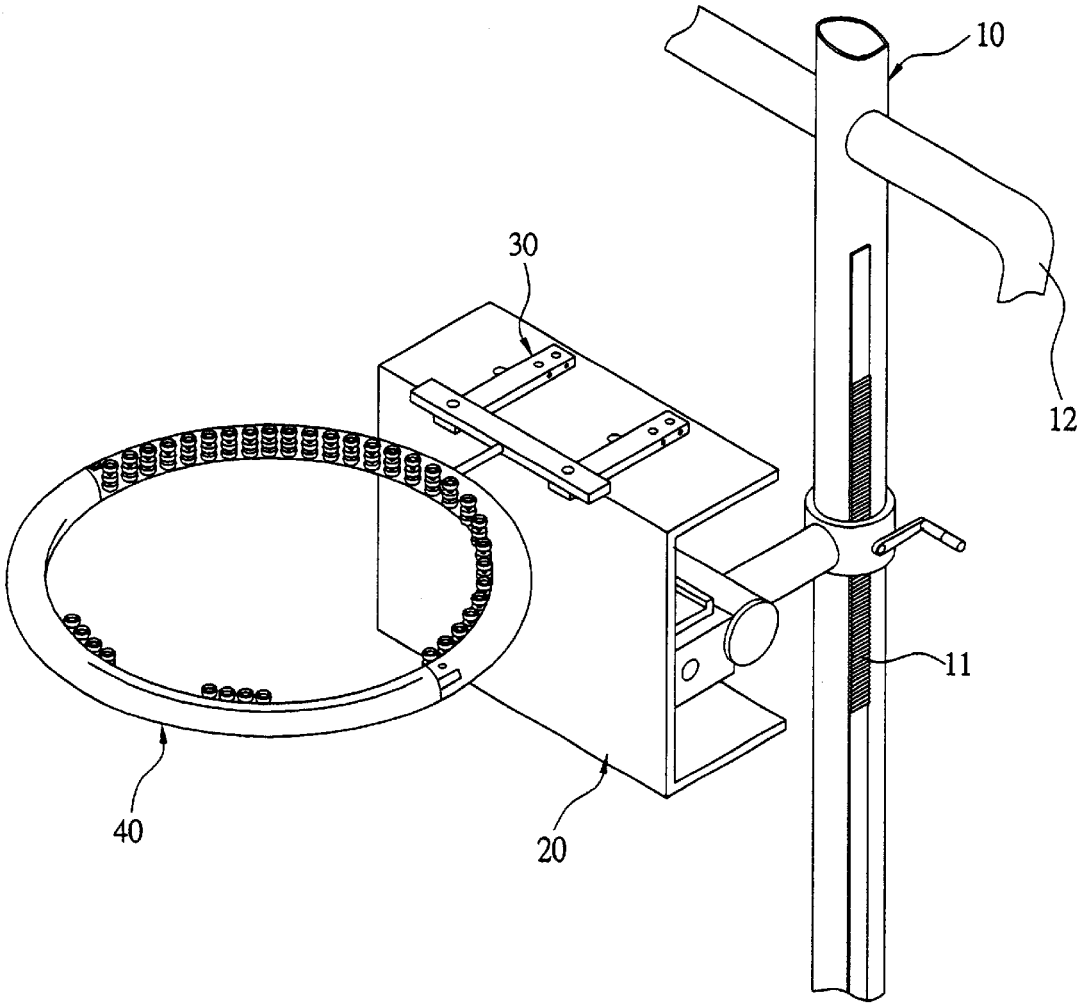
FIG. 2 is a partial, perspective view of the waist training machine mechanism according to the present invention.
Figure 3:
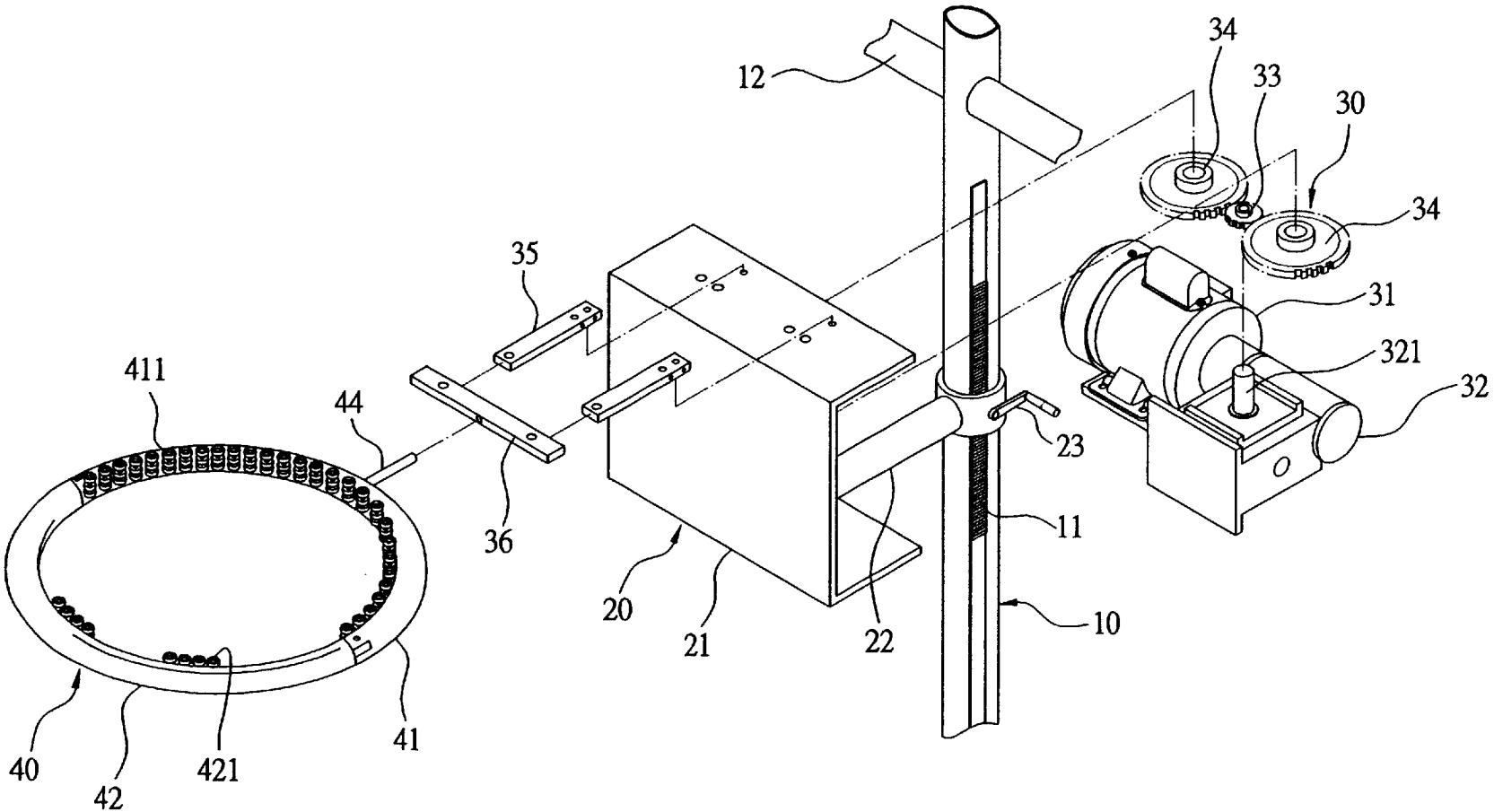
FIG. 3 is an exploded view of the mechanism illustrated in FIG. 2.
Figure 4:
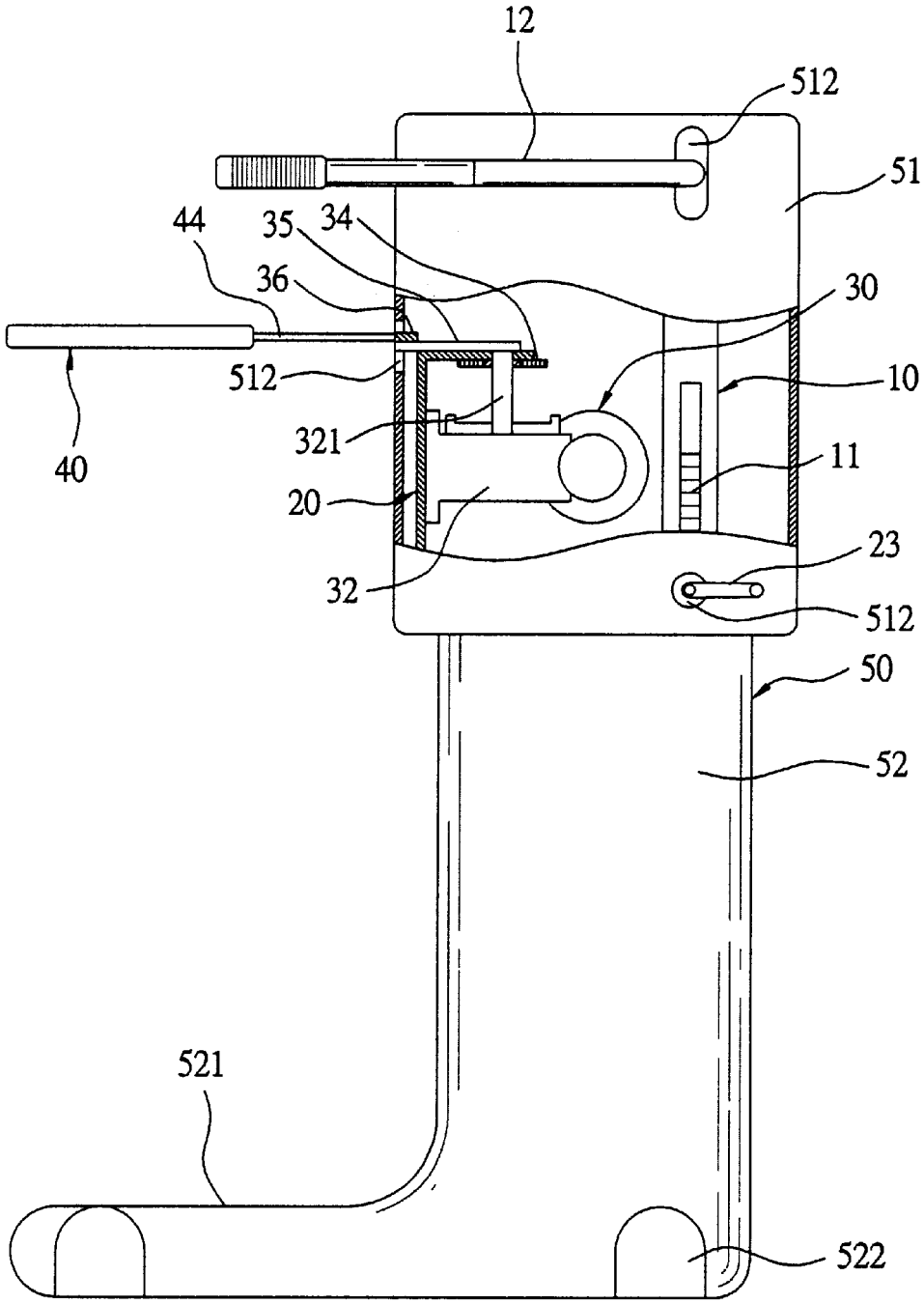
FIG. 4 is a side view, partially broken away, of the present invention.

A preferred embodiment of a waist training machine in the present invention, as shown in FIGS. 1 and 2, includes a post 10, a fixing base 20, a moving mechanism 30, a hoop body 40 and a hull 50 as main components combined together.

The post 10 has a proper length, provided with a rack 11 fixed lengthwise on the post 10, for the fixing base 20 to combine with movably up and down along the post 10. Further, a U-shaped grip 12 is fixed on the top end, extending to both sides of the post 10.

The fixing base 20 has a base body 21, a support arm 22 extending horizontally backward from an inner surface of the base body 21 and having its rear end fitting movably around the post 10 so as to adjust the fixing base 20 up and down relative to the post 10.

Figure 5:
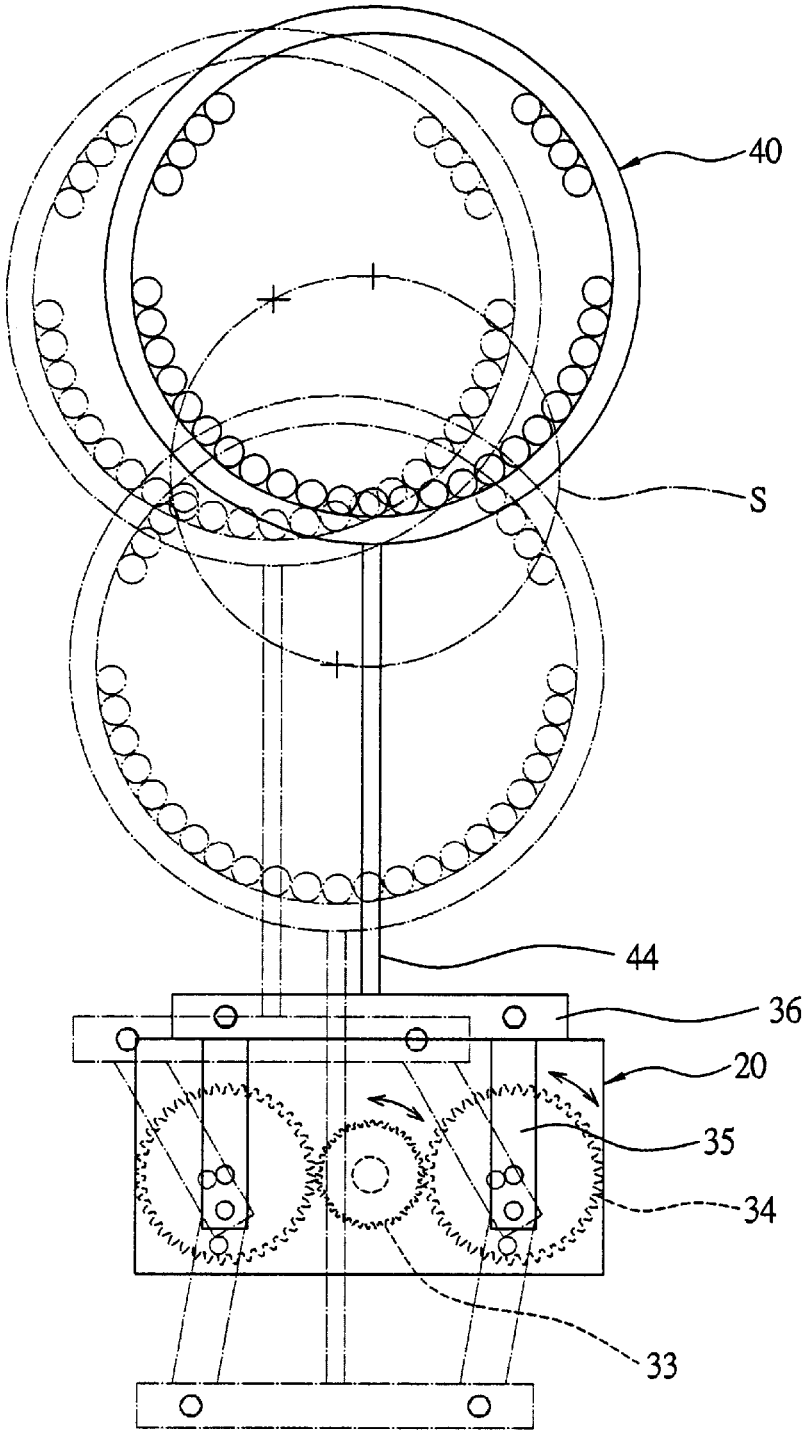
FIG. 5 is a diagrammatic top view illustrating the movement of the hoop body according to the present invention.

The moving mechanism 30 consists of a motor 31, a speed-reducer 32, a main gear 33, two subordinate gears 34, two rotating arms 35, and an interactive arm 36. The motor 31 has a spindle connected with the speed-reducer 32, which reduces the speed of the motor 21 to supply a high output torque. The motor 31 and the speed-reducer 32 are properly deposited in the fixing base 20, and the speed-reducer 32 has an output shaft 321 fixed with the main gear 33 thereon, and the two subordinate gears 34 respectively positioned in the fixing base 20 and respectively engaging with the main gear 33 to rotate together synchronously. The two rotating arms 35 have one end respectively fixed with the shaft of the two subordinate gears 34 to rotate together synchronously. The interactive arm 36 has its two ends respectively connected pivotally with the two rotating arms 35, which then move in parallel for a circle as though in a circular track as twisting the waist, as shown in FIG. 5.

Figure 6:
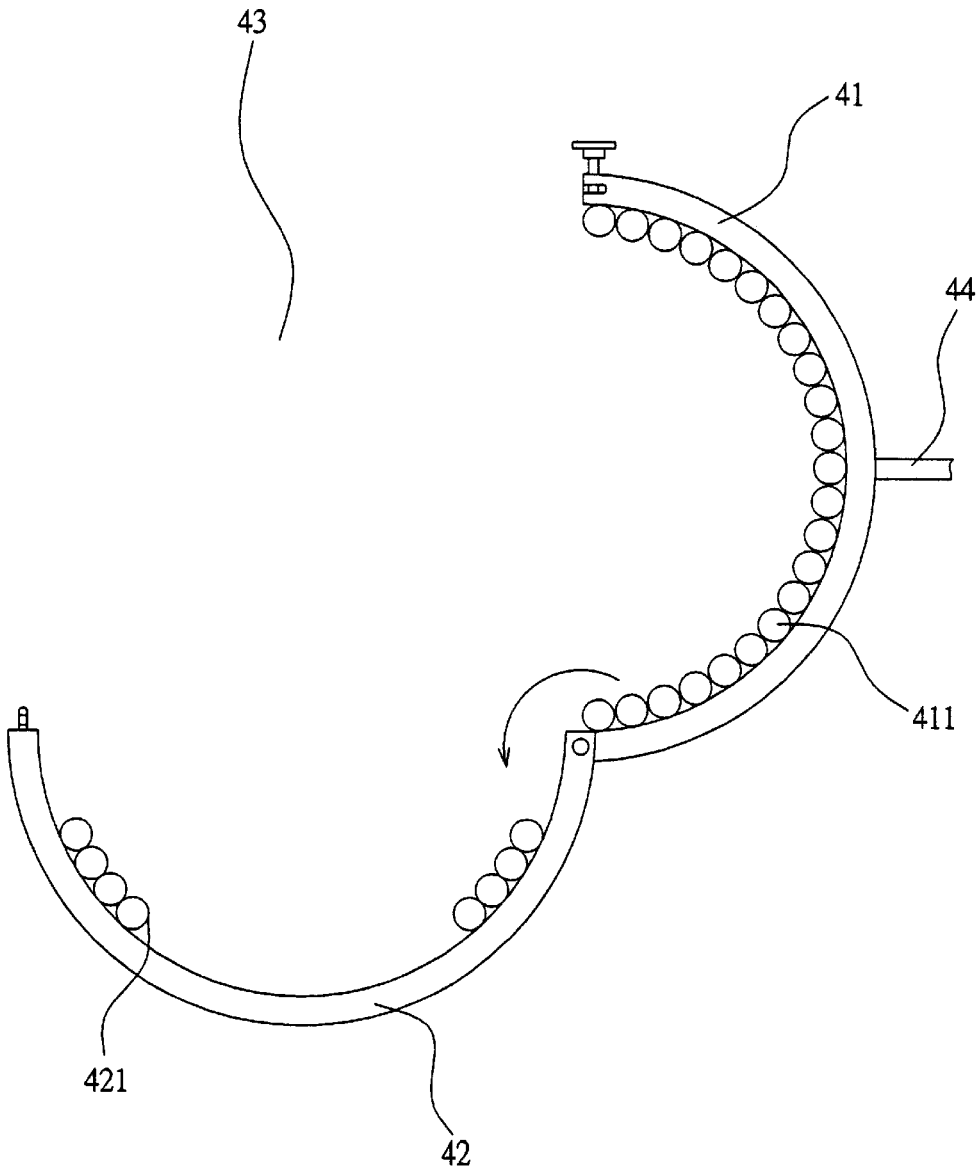
FIG. 6 is a partial top view of the hoop illustrating the hoop in an open position.
Figure 7:
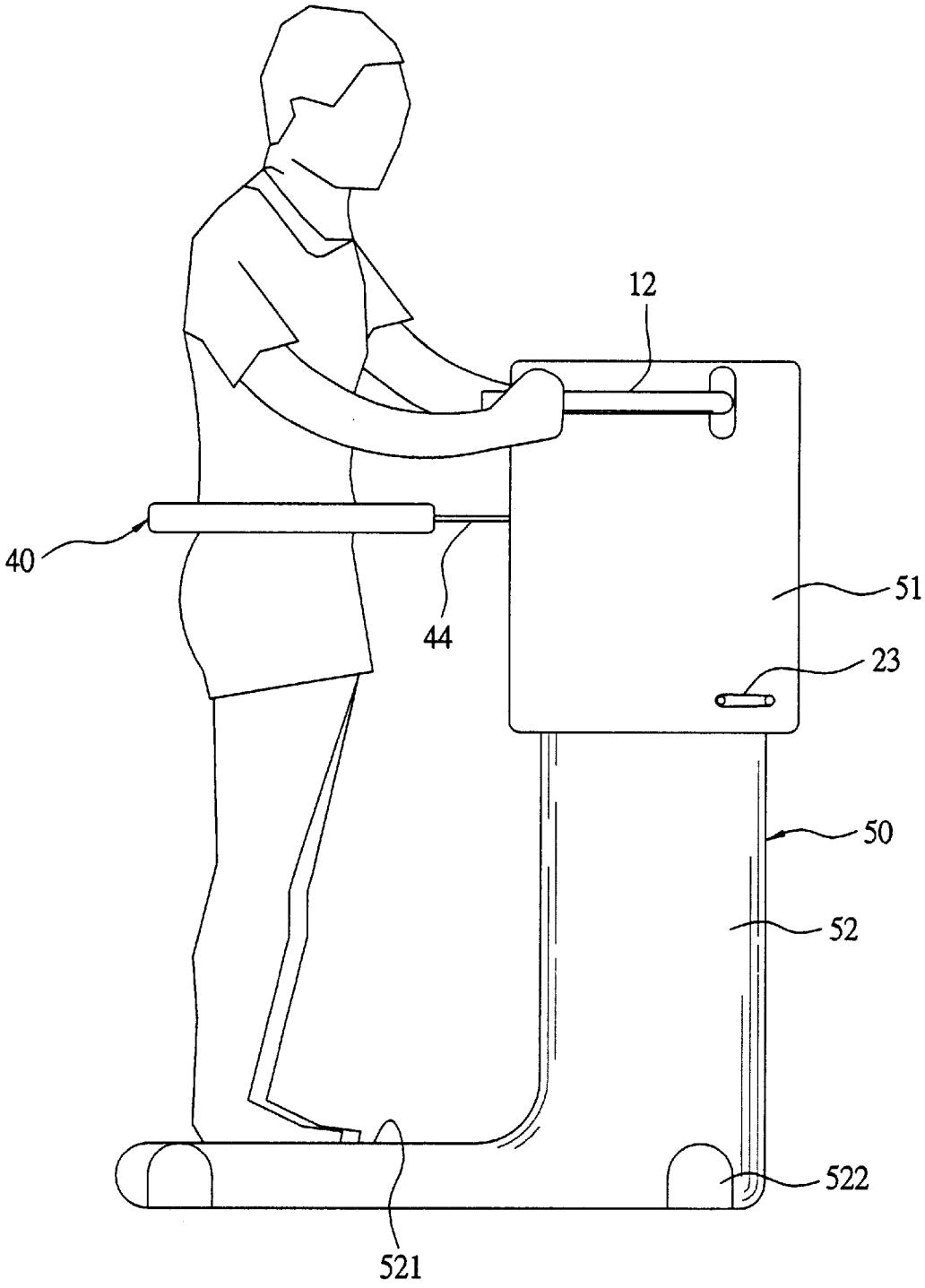
FIG. 7 is a schematic side view illustrating the usage of the waist training machine according to the present invention.

The hoop body 40 consists of an immovable portion 41 and a movable portion 42 combined together. As shown in FIG. 6, the immovable portion 41 has one end pivotally connected with the movable portion 42, and the other end elastically hooking with the other end of the movable portion 42 so the movable portion 42 may be separated from the hooking end with the pivotal end to form an entrance 43 for the waist of a user to move in the inner space of the hook body 40 and the hook end of the movable portion 42 is moved to hook with the other end of the immovable portion 41 to form a complete hook body 40. Many massage rollers 421 are fixed on an inner surface of the immovable portion 41, and plural massage rollers 421 but less than those 421 in the immovable portion 41 are also fixed in an inner surface of the movable portion 42. Further, a connect rod 44 has an end fixed on an outer center surface of the immovable portion 41 and the other end fixed with a intermediate portion of the interactive arm 36.

The hull 50 consists of an upper hull 51 and a lower hull 52. The upper hull 51 surrounds around the upper portion of the post 10 and the fixing base 20 with the moving mechanism 30, having a panel 511 fixed on the top, and a plurality of through holes 512 located in a front side and a right and a left side respectively for the grip 12, the connect rod 44 of the hoop body 40 and the swing handle 23 to extend out. The lower hull 52 surrounds the lower portion of the post 10. A flat forward portion 521 extends forward from the bottom of the post 10 for a user to stand thereon, and four foot bases 522 are provided at four corners of the flat forward portion 521 to stabilize the whole machine on the ground.

The fixing base 20 can also be moved up and down along the post 10 by other ways such as air or oil cylinders.

Next, how to use the waist-twisting machine will be described. As shown in FIGS. 5 and 6, at first, the movable portion 42 of the hoop body 40 is swung open to make the entrance 43 for a user to enter the hoop body 40, and the height of the hoop body 40 has to be checked to be proper or not for the user. If it is not, the user swings the swing handle 23 of the fixing base 20 to move the hoop body 40 to the best position. Then the movable portion 42 is swung to close the hoop body 40. The user rests some portion of his/her body on the massage rollers 411, 421 on the inner surface of the hoop body 40, standing on the flat forward portion 52, and controls the panel 511 to start the motor 31, which has its moving force transmitted to the main gear 33 via the speed-reducer 32 and then to the two subordinate gears 34, which then rotate synchronously to move the two swing arms 35 and then to the interactive arm 36. Then the interactive arm 36 makes horizontal movement in a circle, causing the hoop body 40 also makes horizontal movement in a circle in the same way as the connect arm 36 due to the interactive arm 36 also connected with the connect rod 44. The center of the hoop body 40 also moves in circle, as shown in FIG. 5, in other words, the hoop body 40 moves in a S-shaped track to compel the waist of the user to move in the same track, letting the user obtain the effect of twisting the waist and the buttocks. During the training, the user can also hold the grip 12 to keep the body balanced, resulting in some training of the arms, too. Further, the user can rest against the massage rollers 411, 421 at the same time so as to acquire massage and to slim the body. As the spine is located in the center portion of the back, unsuitable for massage, it is preferable that the hoop body 40 is not provided with the massage rollers 411, 421 at the locations corresponding to the spine.

In general, the invention has the following advantages.

1. The hoop body can produce a circular movement to compel a user's body also move in the same way to obtain twisting effect to his/her body, with the arms is possible to be raised for exercise at the same time by holding the grip.
2. The numerous massage rollers provided on the inner surface of the hoop body can produce massage function against the waist of the user, carrying out massage and slimming.
3. A user can get the most suitable speed of clockwise and counterclockwise rotation of the hoop body rotated by the motor with the speed-reducer by controlling and adjusting the panel through the computer, acquiring the best effect of body fitting.

While the preferred embodiment of the invention has been described above, it will be recognized and understood that various modifications may be made therein and the appended claims are intended to cover all such modifications that may fall within the spirit and scope of the invention.

What is claimed is:

1. A waist twisting machine comprising:

A post vertically positioned for supporting a fixing base;

A moving mechanism consisting of a power source, a gear units, two rotating arms and an interactive arm; said power source deposited in said fixing base and driving said gear units, said two rotating arms respectively having one end pivotally connected with said gear units to rotate together synchronously, said interactive arm having two ends respectively pivotally connected with said two rotating arms, said interactive arm moving horizontally in a circle together with said two rotating arms;

A hoop body possible to be opened to make up an entrance to enter said hoop body, having a plurality of massage rollers fixed on an inner surface, and a connect rod fixed between an outer surface of said hoop body and said interactive arm of said moving mechanism;

Said hoop body moved as a hula hoop in a circle by said moving mechanism, compelling the waist of a user standing with the body in the hoop body to move regularly in the same track as said hoop body, said massage rollers touching and massaging the waist of the user with light pressure, letting the user acquire effect of twisting and slimming.

2. The waist twisting machine as claimed in claim 1, wherein a U-shaped grip is fixed at the top of said post, extending to both sides of said post, said post has a lengthwise rack, said fixing base has a base body, a support arm is provided to extend out of said base body rearward, with a swing handle fixed at a connect point of said support arm with said post and engaging with said rack so that said fixing base may be moved up and down along said post by means of said swing handle.

3. The waist twisting machine as claimed in claim 1, wherein said power source consists of a motor and a speed-reducer connected with each other by means of a shaft, said gear unit has a main gear connected with a shaft of said speed-reducer, and two subordinate gears respectively have a shaft fixed in said fixing base and engaging with said main gear to rotate synchronously, connected with said interactive arm.

4. The waist twisting machine as claimed in claim 1, wherein said hoop body consists of a immovable portion and a movable portion, said immovable portion having one end pivotally connected with one end of said movable portion and the other end releasably hooking with the other end of said movable portion so that the hoop body may be opened to form an entrance for a user to enter the hoop body and then closed, with said massage rollers touching and making massage to the waist of the user.

5. The waist twisting machine as claimed in claim 1, wherein a hull is provided to surround said post, said fixing base and said moving mechanism, and a panel is fixed oil the top of said post and a flat forward portion is provided to extend forward from the bottom of said post, with four foot bases provided at four corners of said flat forward portion to stabilize said machine on the ground.

* * * * *